US009422688B2

(12) United States Patent
Ingalls

(10) Patent No.: US 9,422,688 B2
(45) Date of Patent: Aug. 23, 2016

(54) SECONDARY CONTAINMENT MAT

(71) Applicant: James Ingalls, Arvada, CO (US)

(72) Inventor: James Ingalls, Arvada, CO (US)

( * ) Notice: Subject to any disclaimer, the term of this patent is extended or adjusted under 35 U.S.C. 154(b) by 20 days.

(21) Appl. No.: 14/542,038

(22) Filed: Nov. 14, 2014

(65) Prior Publication Data

US 2015/0132534 A1 May 14, 2015

Related U.S. Application Data

(60) Provisional application No. 61/904,363, filed on Nov. 14, 2013.

(51) Int. Cl.
*E01C 9/08* (2006.01)
*E02D 31/00* (2006.01)

(52) U.S. Cl.
CPC ..... *E02D 31/004* (2013.01); *Y10T 428/24091* (2015.01)

(58) Field of Classification Search
CPC ..... Y10T 428/18; Y10T 428/183; Y10T 428/24058; Y10T 428/24066; E01C 9/086
See application file for complete search history.

(56) References Cited

U.S. PATENT DOCUMENTS 5,273,373 A * 12/1993 Pouyer ..... E01C 9/086 404/35

* cited by examiner

*Primary Examiner* — Alexander Thomas
(74) *Attorney, Agent, or Firm* — Holland & Hart LLP

(57) ABSTRACT

Improved secondary containment mats and systems of secondary containment mats may include a top surface and a bottom surface, with a liner material placed between the top and bottom surfaces. Multiple mats may provide a modular structural mat system that may be installed at a drill site, with multiple mats placed adjacent to each other to provide containment of potential spills, a reliable working surface for drilling operations, and relatively fast and less expensive installation. The top surface may include a number of adjacent boards, and the bottom surface may include a number of boards at least some of which include gaps therebetween. The liner may be a 100 mil well pad liner, and may extend beyond the edges of the top and bottom surfaces. The top and bottom surfaces may be interconnected through any of a number of techniques, such as nails or bolts.

10 Claims, 7 Drawing Sheets

SECONDARY CONTAINMENT MAT

BACKGROUND

This applications claims priority to U.S. Provisional Patent Application no. 61/904,363, filed on Nov. 14, 2013 and entitled "Secondary Containment Mat," the entire disclosure of which is incorporated herein by reference.

BACKGROUND

1. Field

Certain aspects of the present disclosure generally relate to containment mechanisms for oil and gas drilling operations, and more particularly to a secondary containment mat for use at oil and gas drilling sites.

2. Background

Oil and gas drilling operations generally involve a drilling rig and associated support equipment that are used to drill and line oil and gas wells, as is well known. During drilling operations, a significant amount of activity occurs at the drilling site involving many different pieces of drilling equipment and support equipment. In order to reduce environmental impact to the areas adjacent and nearby to drilling sites, sites are commonly lined with liner to help prevent any liquids spilled at the drill site from penetrating the ground or entering a water supply. Additionally, matting may be installed around the drill site to provide a working surface and keep traffic from directly contacting liner material and potentially damaging the liner. Additionally, matting may help reduce impact on the ground area around drill sites from traffic and equipment at the drill site, such as ruts, erosion, excessive soil compaction, etc.

While helping to reduce environmental impacts, current lining and matting may take a significant amount of time and cost to install. Additionally, as liner material is often placed directly on the ground surface, tears and/or punctures may occur, thereby reducing the effectiveness of the liner. Accordingly, it may be desirable to have more efficient and reliable containment and matting systems.

SUMMARY

The described features generally relate to one or more improved secondary containment mats and systems of secondary containment mats. According to certain examples, a secondary containment mat includes a top surface and a bottom surface, with a liner material placed between the top and bottom surfaces. The mat thus provides a modular structural mat that may be installed at a drill site adjacent to a number of other mats to provide containment of potential spills, a reliable working surface for drilling operations, and relatively fast and less expensive installation. In some examples, the top surface may include a number of adjacent boards, and the bottom surface may include a number of boards at least some of which include gaps therebetween. The liner may be, for example, a 100 mil well pad liner, and may extend beyond the edges of the top and bottom surfaces. In some embodiments, the liner of adjoining mats may be joined together to provide enhanced spill protection. The top and bottom surfaces may be interconnected through any of a number of techniques, such as nails or bolts, for example. In some embodiments, boards of the top and bottom surfaces are bolted together, and a traction surface may be applied to the top surface of the mat to provide enhanced traction for people and vehicles that may use the mat.

Further scope of the applicability of the described methods and apparatuses will become apparent from the following detailed description, claims, and drawings. The detailed description and specific examples are given by way of illustration only, since various changes and modifications within the spirit and scope of the description will become apparent to those skilled in the art.

BRIEF DESCRIPTION OF THE DRAWINGS

A further understanding of the nature and advantages of the present invention may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Described embodiments are directed to apparatuses, systems and methods for improved secondary containment mats and systems of secondary containment mats. According to embodiments, a secondary containment mat includes a top surface and a bottom surface, with a liner material placed between the top and bottom surfaces. The mat thus provides a modular structural mat that may be installed at a drill site adjacent to a number of other mats to provide containment of potential spills, a reliable working surface for drilling operations, and relatively fast and less expensive installation. In some embodiments, the top surface may include a number of adjacent boards, and the bottom surface may include a number of boards at least some of which include gaps therebetween. The liner may be, for example, a 100 mil well pad liner, and may extend beyond the edges of the top and bottom surfaces. In some embodiments, the liner of adjoining mats may be joined together to provide enhanced spill protection. The top and bottom surfaces may be interconnected through any of a number of techniques, such as nails or bolts, for example. In some embodiments, boards of the top and bottom surfaces are bolted together using structural spiral shank fasteners. Thus, a modular structural mat may be provided for use in all stages of, for example, oil and gas well development (e.g., from pad development to drilling, to completions to production). Such mats may also be used for other applications, such as pipeline companies or utility companies that may use a series of interconnected mats to build a road or other traveling/staging surface during construction, to name but a couple of examples. It will be readily understood by one of skill in the art that such modular structural mats may be used in numerous different applications and environments.

Thus, the following description provides examples, and is not limiting of the scope, applicability, or configuration set forth in the claims. Changes may be made in the function and arrangement of elements discussed without departing from the spirit and scope of the disclosure. Various embodiments may omit, substitute, or add various procedures or components as appropriate. Also, features described with respect to certain embodiments may be combined in other embodiments.

Figure 1:
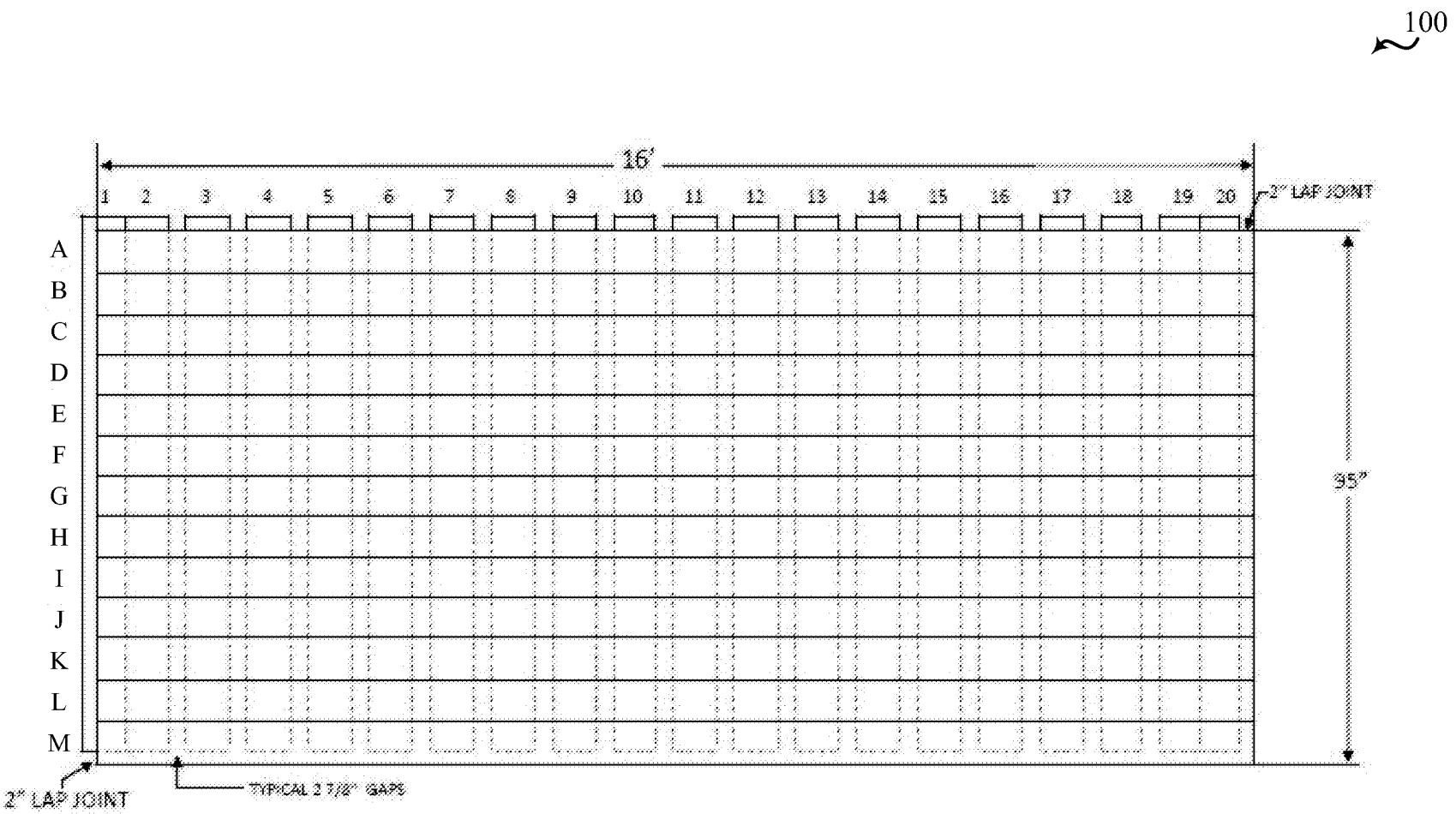
FIG. 1 is a top view of a secondary containment mat apparatus in accordance with various aspects of the present disclosure.
Figure 2:
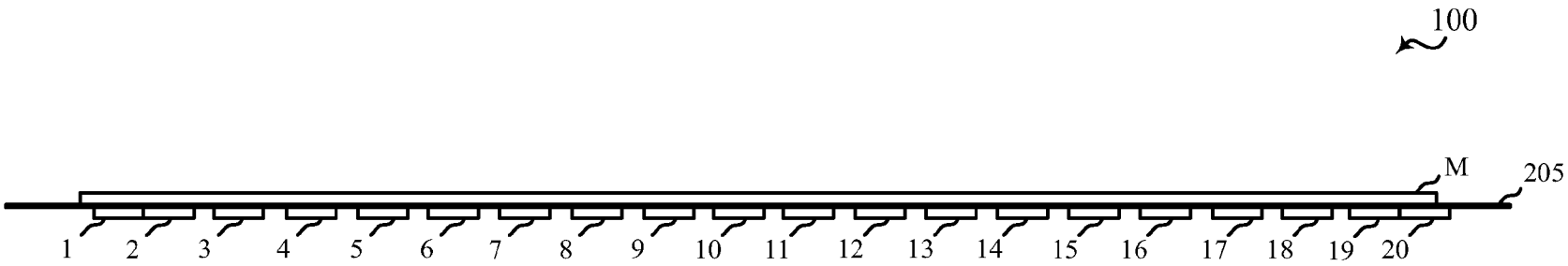
FIG. 2 shows a side view of the secondary containment mat apparatus of FIG. 1 in accordance with various aspects of the present disclosure.

Referring first to FIGS. 1 and 2, top and side views, respectively, of a mat 100 are illustrated. In this embodiment, the mat is approximately 16 feet (4.88 meters) by 8 feet (2.44 meters). The mat 100 has a top surface made up of dimensional lumber that in this embodiment includes 13 adjacent "2×8" pieces of kiln dried lumber, designated as boards A through M in FIGS. 1 and 2. As will be readily recognized by one of skill in the art, a "2×8" piece of dimensional lumber may have an actual net board size of 1.5 inches (38.1 mm) by 7.25 inches (184 mm), and thus the 13 adjacent boards A through M result in a width of the mat 100 of approximately 8 feet (2.44 meters). In this embodiment, the boards A-M of the top surface are 16 feet (4.88 meters) long.

The bottom surface in this embodiment includes 20 pieces of dimensional lumber, indicated as 1 through 20 in FIGS. 1 and 2. Boards 1 through 20 are arranged transversely to boards A through M. In this example, the mat 10 includes two adjacent boards (1, 2, and 19, 20) at each end that have little or no gap, with 16 equally spaced boards (3 through 18) with gaps of approximately 2⅞ inches (73 mm) Of course, it is to be understood that the dimensions provided here are for purposes of illustration and discussion only, and other dimensions and arrangements may be utilized as will be readily recognized by one of skill in the art. Also, it is to be noted that the figures are not drawn to scale, and various elements may be illustrated as being enlarged or reduced in order to illustrate various concepts and techniques described herein.

Between top and bottom surfaces is a liner 205. Such a liner may be a well pad liner such as commonly used in present day drilling operations, and in some embodiments is a 100 mil (2.54 mm) liner located between the top and bottom surfaces with a 12 inch (304.8 mm) overlap on all 4 sides. This, the mat 100 provides a two-ply secondary containment with a liner between the plys. The liner 205 may be, for example, a polypropylene composite liner having a number of barrier films sandwiched by geotextile with heat fused surfaces. Such a liner 205 may absorbs relatively small leaks and spills, and help prevent larger spills from reaching the ground and/or water supplies.

Figure 3:
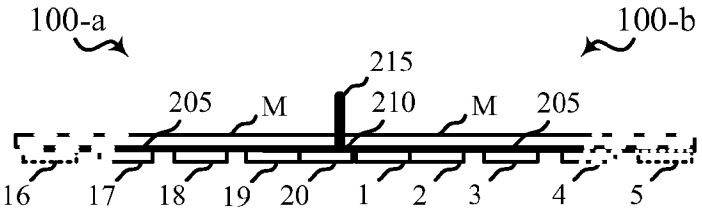
FIG. 3 shows a side view of two adjacent secondary containment mats in accordance with various aspects of the present disclosure.

During installation, multiple mats 100 may be placed adjacent to one another to provide a lined working surface. FIG. 3 illustrates a partial side view of an intersection of two adjacent mats 100-*a* and 100-*b*. In this example, each mat 100 has a 2 inch lap joint (illustrated in FIG. 1) that may overlap with a corresponding extension of the bottom surface of an adjoining mat 100. These may be adjoined, as illustrated at 210 in FIG. 3, to provide adjoining mats 100 that are partially interlocked. As noted above, liner 205 may extend beyond edges of the mats 100, and overlapping areas of adjoining liners may be connected, as indicated at 210 in FIG. 3. Portions of adjoining liners 205 may be sealed together to provide enhanced containment of any spills. Such sealing may be through heat sealing, adhesive, taping, or any other suitable means to interconnect liners 205. The joined liners may be folded down onto the top surface, or excess liner may be cut away. In some deployments, interconnected mats 100, after being interconnected and any sealing completed, may have a top sealing coat applied thereto to provide enhanced containment of potential spills, In some examples, such a top sealing coat may be sprayed onto the mats 100, and gravel, sand, or other enhanced gripping material may be applied with the sealing coat, or separate from the sealing coat, and may provide an enhanced gripping surface on the top surface of the mats 100. In some examples, the top coat may be a two part polymer that protects the mat and the liner below. Sand, or other abrasive material, may be integrated into the polymer creating a traction surface to assist with personnel safety.

Figure 5:
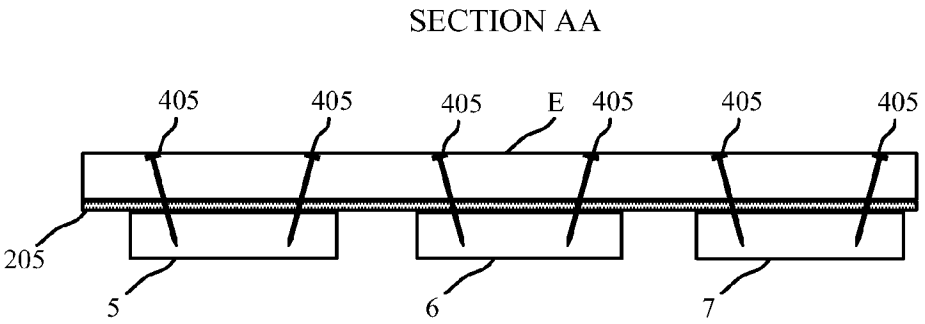
FIGS. 5 and 6 show cross section views of the mat illustrated in FIG. 5 in accordance with various aspects of the present disclosure.
Figure 6:
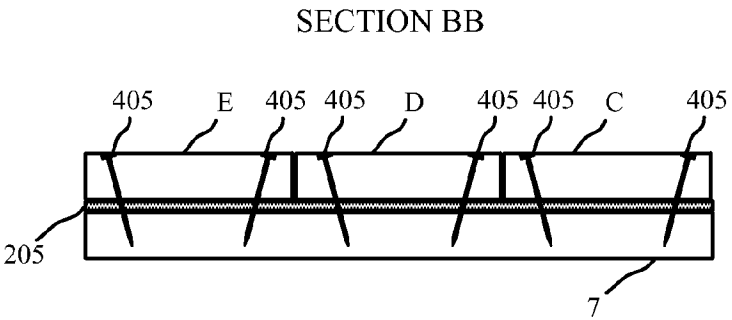
Figure 4:
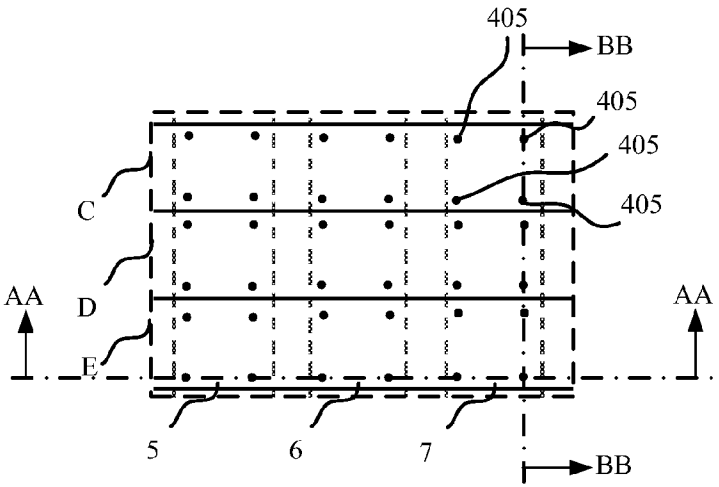
FIG. 4 shows a top view of a portion of a secondary containment mat in accordance with various aspects of the present disclosure.
Figure 7A:
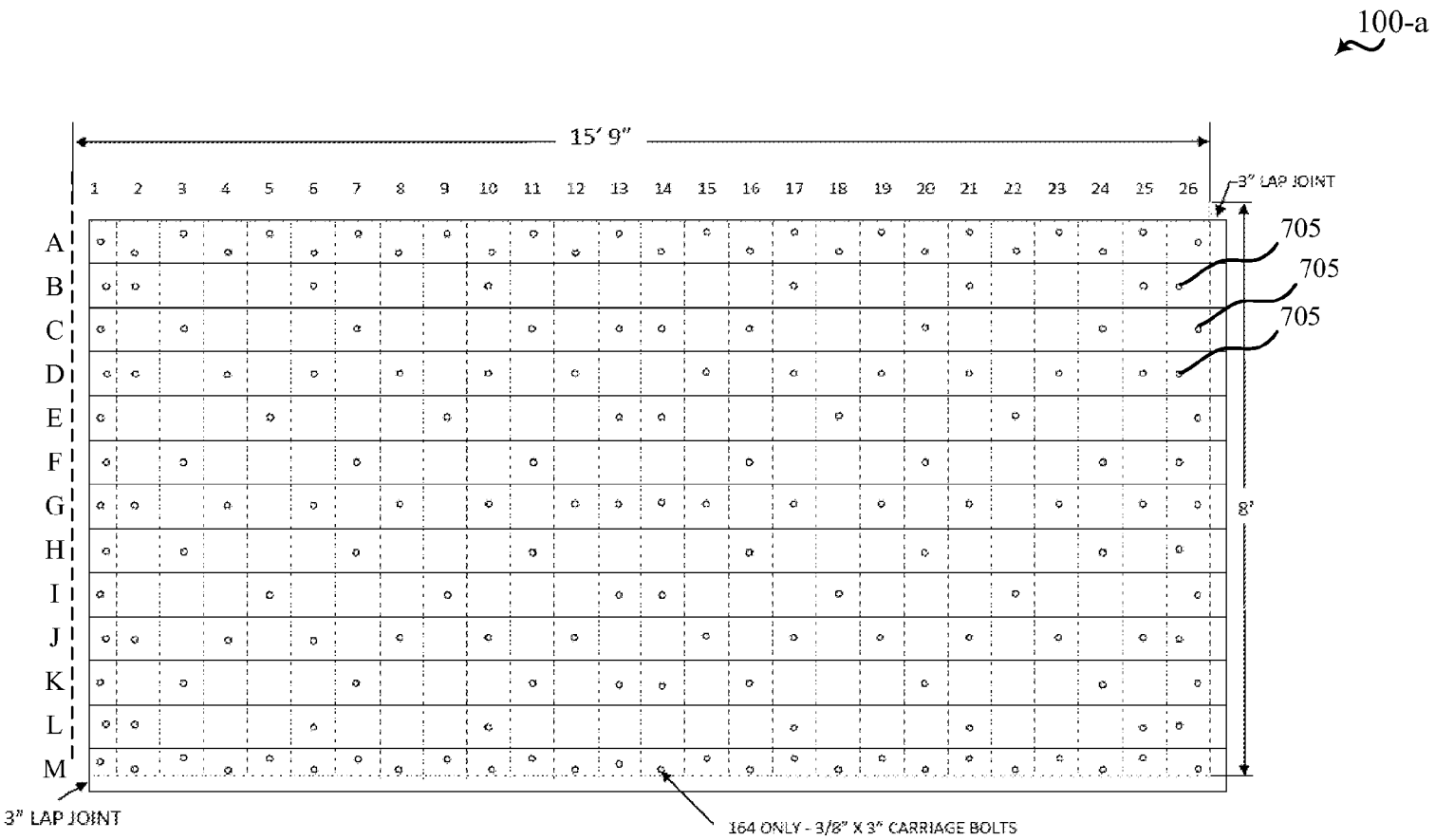
FIG. 7A is a top view of another example of a secondary containment mat apparatus in accordance with various aspects of the present disclosure.
Figure 8:
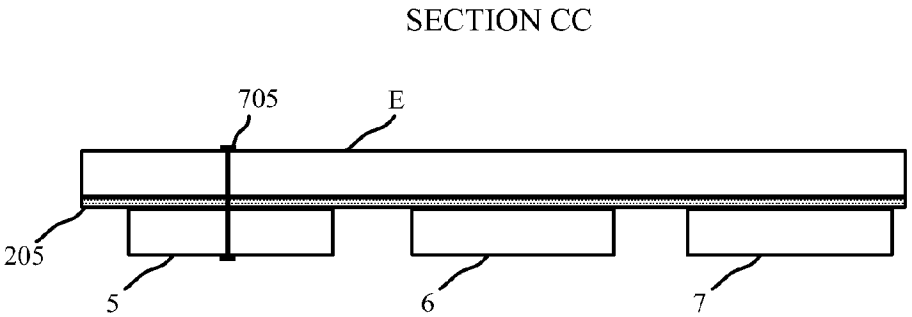
FIGS. 8 and 9 show cross section views of the mat illustrated in FIG. 7 in accordance with various aspects of the present disclosure.
Figure 9:
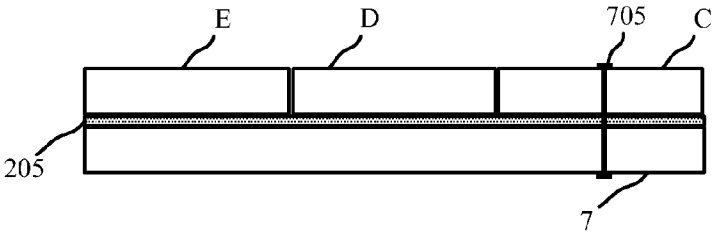
Figure 7B:
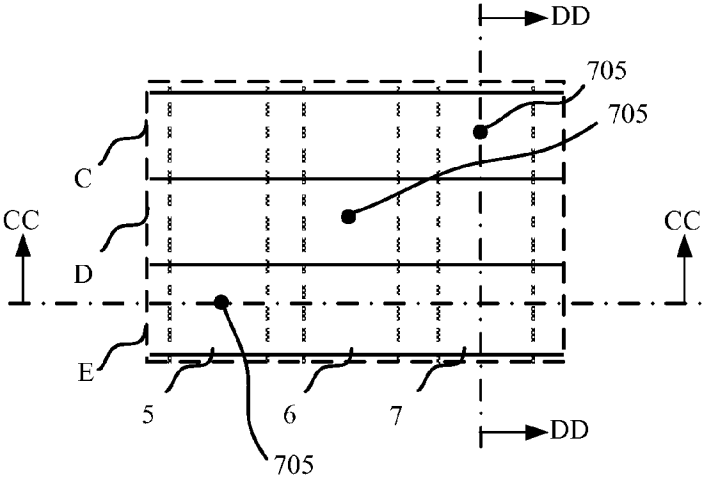
FIG. 7B shows a top view of a portion of the example secondary containment mat of FIG. 7A in accordance with various aspects of the present disclosure.

As mentioned above, top and bottom layers of mats 100 may be secured together through any of a number of interconnection techniques. With reference now to FIGS. 4-6, an embodiment is described that utilizes nails 405 for securing boards together. In this example, each intersection of boards in the top and bottom surfaces include four opposed angle structural spiral shank nails. In some embodiments, nails 405 are coated to prevent rusting (which with a 'common nail' is one of the prime reasons for loosening). A structural spiral shank nail also have relatively high resistance to pull out, which may enhance reliability of the mat 100. Nails 405, in some embodiments, are three inch nails. Each nail may be angled, as illustrated in cross-section views of FIGS. 5 and 6, from the outer edge of the board intersection, towards the center of the intersection. In some embodiments, this angle is approximately 12 degrees, and may provide enhanced structural support to mats 100. While nails 405 are illustrated in FIGS. 4-6, it will be readily understood by one of skill in the art that other techniques may be used to secure top and bottom surfaces to one another, such as, for example, different types of nails, bolts, rivets, interlocking members, or other fasteners, or combinations thereof. One such example of another technique to secure top and bottom layers of mats 100 is illustrated in FIGS. 7-9, and uses bolts 705 for securing boards together. In this example, a number of intersections of boards in the top and bottom surfaces include a bolt 705 for securing the boards together. In some examples, boards 1-26 and A-M may be secured together with ⅜" (9.5 mm) by 3" (76.2 mm) inch long carriage bolts with 1 inch (25.4 mm) flanged nuts. As discussed above, it will be readily understood by one of skill in the art that other techniques may be used to secure top and bottom surfaces to one another.

Figure 10:
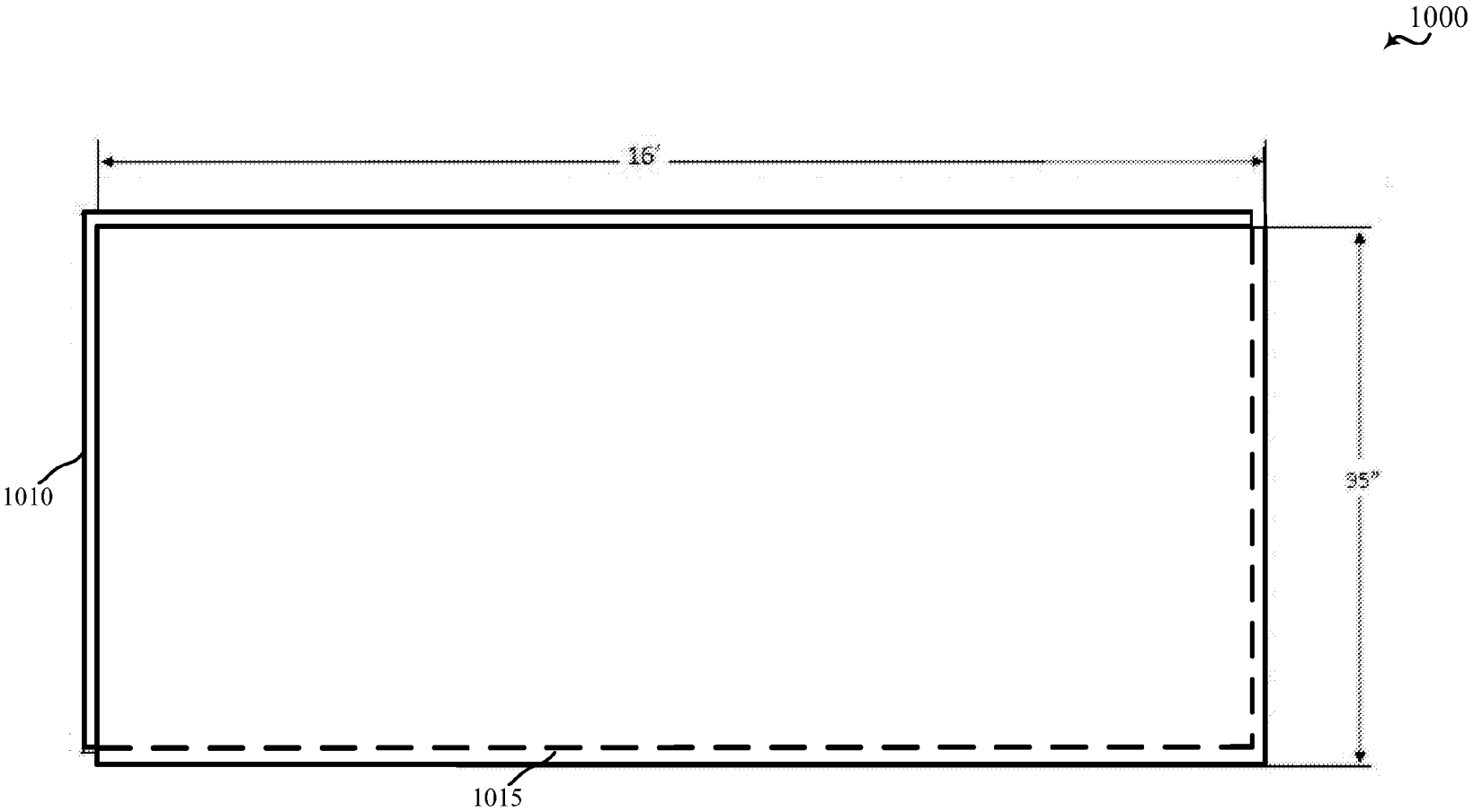
FIG. 10 shows a top view of another secondary containment mat apparatus in accordance with various aspects of the present disclosure.
Figure 11:
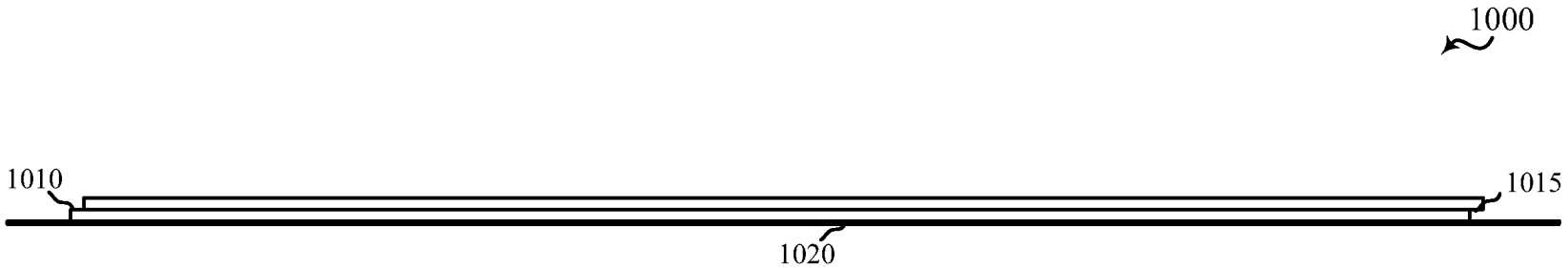
FIG. 11 shows a side view of the secondary containment mat apparatus of FIG. 10 in accordance with various aspects of the present disclosure.

Referring next to FIGS. 10 and 11, top and side views, respectively, of another exemplary mat 1000 are illustrated. In this embodiment, the mat is again approximately 16 feet (4.88 meters) by 8 feet (2.44 meters). The mat 1000 in this example is made of an engineered wood product and is a single piece of material. In some examples, the mat may be formed from multiple plys of laminated wood material that may be arranged with different orientations to provide substantial strength and durability. In some examples, the mat may be formed from cross laminated timber, such as Crosslam™ Ultracore available from StructureLam of Penticton, British Columbia, Canada. Again, it is to be understood that the dimensions provided here are for purposes of illustration and discussion only, and other dimensions and arrangements may be utilized as will be readily recognized by one of skill in the art. Also, it is to be noted that the figures are not drawn to scale, and various elements may be illustrated as being enlarged or reduced in order to illustrate various concepts and techniques described herein. In certain examples, mats 1000 may be configured to be interconnected through a joint 1025, shown in FIG. 12, having a bottom shelf 1010 and a top extension 1015. Of course, other types of joints 1025 may be implemented, such as a tongue and groove, etc.

Figure 12:
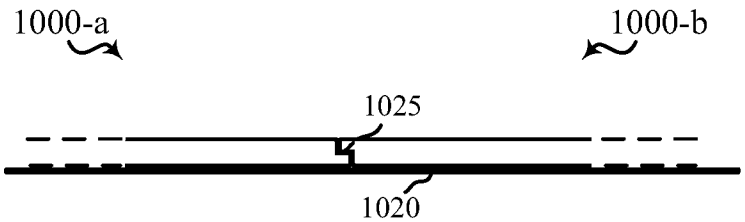
FIG. 12 shows a side view of two adjacent secondary containment mats of FIG. 10 in accordance with various aspects of the present disclosure.

A liner 1020 may be placed under some or all of a number of mats 1000, as illustrated in FIGS. 11 and 12, in some examples. Such a liner may be a well pad liner such as commonly used in present day drilling operations, and in some embodiments is a 100 mil liner. The liner 1020 may be, for example, a polypropylene composite liner having a number of barrier films sandwiched by geotextile with heat fused surfaces. Such a liner 1020 may absorb relatively small leaks and spills, and help prevent larger spills from reaching the ground and/or water supplies.

During installation, multiple mats 1000 may be placed adjacent to one another to provide a lined working surface. FIG. 12 illustrates a partial side view of an intersection of two adjacent mats 1000-*a* and 1000-*b*. In this example, each mat 1000 is interconnected at joint 1025, to provide adjoining mats 1000 that are partially interlocked. In some deployments, as discussed above, interconnected mats 1000, before or after being interconnected, may have a top sealing coat applied thereto to provide enhanced containment of potential spills, In some examples, such a top sealing coat may be sprayed onto the mats 1000, and gravel, sand, or other enhanced gripping material may be applied with the sealing coat, or separate from the sealing coat, and may provide an enhanced gripping surface on the top surface of the mats 1000.

The previous description of the disclosure is provided to enable a person skilled in the art to make or use the disclosure. Various modifications to the disclosure will be readily apparent to those skilled in the art, and the generic principles defined herein may be applied to other variations without departing from the spirit or scope of the disclosure. Throughout this disclosure the term "example" or "exemplary" indicates an example or instance and does not imply or require any preference for the noted example. Thus, the disclosure is not to be limited to the examples and designs described herein but is to be accorded the widest scope consistent with the principles and novel features disclosed herein.

What is claimed is:

1. A modular structural mat, comprising:

a top surface comprising a plurality of adjacent boards arranged parallel to one another in a first direction;

a bottom surface comprising a plurality of adjacent boards arranged parallel to one another in a second direction that is perpendicular to the first direction; and a liner material placed between the top and bottom surface;

wherein the top surface is offset from the bottom surface to create a lap joint along each edge of the mat, the lap joint configured to engage with a corresponding lap joint of an adjacent mat.

2. The modular structural mat of claim 1, wherein each board of the top surface is coupled with a subset of the boards of the bottom surface.

3. The modular structural mat of claim 2, wherein the boards of the top surface are coupled with the subset of the boards of the bottom surface with a bolt and nut.

4. The modular structural mat of claim 1, wherein the liner material is a 100 mil well pad liner.

5. The modular structural mat of claim 4, wherein the liner material extends beyond each of the edges of the top and bottom surfaces.

6. The modular structural mat of claim 5, wherein the liner material is joined to a liner material of a similar adjoining structural mat.

7. The modular structural mat of claim 1, further comprising a top coat applied to the top of the top surface.

8. The modular structural mat of claim 7, wherein the top coat provides enhanced containment for any spills on the modular structural mat.

9. The modular structural mat of claim 8, wherein the top coat includes a traction surface to provide enhanced traction for people and vehicles that may use the mat.

10. The modular structural mat of claim 8, wherein the top coat comprises a two part polymer adapted to protect the modular structural mat and the liner, and sand integrated into the two part polymer to provide a traction surface.

* * * * *